United States Patent [19]

Vogelsberg et al.

[11] Patent Number: 4,570,432

[45] Date of Patent: Feb. 18, 1986

[54] TWO-STAGE TWISTING DEVICE FOR COMMUNICATION CABLES

[75] Inventors: Dieter Vogelsberg, Coburg; Wolfgang Feese, Neustadt, both of Fed. Rep. of Germany

[73] Assignee: Siemens Aktiengesellschaft, Munich, Fed. Rep. of Germany

[21] Appl. No.: 721,599

[22] Filed: Apr. 10, 1985

[30] Foreign Application Priority Data

Apr. 12, 1984 [DE] Fed. Rep. of Germany ..... 3414017
Jan. 28, 1985 [DE] Fed. Rep. of Germany ..... 3503254

[51] Int. Cl.[4] ..... H01B 13/04

[52] U.S. Cl. ..... 57/293; 57/294; 57/311; 57/314

[58] Field of Search ..... 57/6, 59, 293, 294, 57/204, 311, 314, 9

[56] References Cited

U.S. PATENT DOCUMENTS

| | | | |
|---|---|---|---|
| 3,507,108 | 4/1970 | Yoshimura et al. | 57/294 |
| 3,884,025 | 5/1975 | Oberender et al. | 57/293 |
| 4,127,982 | 12/1978 | Braun et al. | 57/294 |
| 4,214,432 | 7/1980 | Scheidt | 57/293 |
| 4,224,788 | 9/1980 | Vogelsberg | 57/294 |
| 4,272,951 | 6/1981 | Vogelsberg | 57/293 |
| 4,328,664 | 5/1982 | Vogelsberg et al. | 57/293 |
| 4,339,913 | 7/1982 | Vogelsberg | 57/294 |
| 4,450,674 | 5/1984 | Bos et al. | 57/293 X |
| 4,493,182 | 1/1985 | Vogelsberg | 57/293 |

FOREIGN PATENT DOCUMENTS 1478351 6/1977 United Kingdom .

OTHER PUBLICATIONS

*Frisch,* Kabel-und Verseilmaschinenbau GmbH, "SZ-Stranding Machines for Communication Cables", six pages.

*Wire Journal,* "High-Speed SZ Twisting and Stranding Machines Using Straight Accumulators", Dieter Vogelsberg, pp. 74–79, Feb. 1978.

*Primary Examiner*—John Petrakes

*Attorney, Agent, or Firm*—Kenyon & Kenyon

[57] ABSTRACT

In the manufacture of bundles of at least ten twisted pairs or quads of electric wires, a compact design of the first twisting stage and a servicable guiding system for guiding the pairs from the first twisting stage to the twisting closer of the second twisting stage is obtained by having at least two groups of SZ-twisting devices in the first twisting stage, the rotating twisting heads of the two stages radially staggered and the guide pulleys of the respective inner twisting head which are arranged at the transition from the first to the second twisting stage provided with several guiding grooves for the twisting units so that they can guide twisted units from both the inner and outer twisting heads.

10 Claims, 10 Drawing Figures

TWO-STAGE TWISTING DEVICE FOR COMMUNICATION CABLES

BACKGROUND OF THE INVENTION

This invention relates to SZ-twisting machines for electric cables in general and more particularly to the mechanical design of a two-stage twisting device, in which a guidance system consisting of guide pulleys for guiding the material to be twisted is arranged at the transition from the first to the second twisting stage.

Two-stage twisting machines are used primarily in the manufacture of communication cables for the combined twisting of conductors to form several twisting units such as pairs, triplets or quads and of the twisting units to form a bundle. It is customary in such a case to arrange the SZ-twisting devices which are working in parallel in the first twisting stage radially with respect to the machine axis, particularly in a concentric distribution about the machine axis. The rotating twisting heads provided at the input and output of the individual SZ-twisting devices are arranged in respective frames which also support the drive devices for the twisting heads. At the transition from the first to the second twisting stage, a special guidance system which consists of guide pulleys and guides each twisting unit up into the vicinity of the machine axis and therefore up into the vicinity of the twisting closer of the second twisting stage is provided.

With regard to each twisting unit, this guidance system consists of at least two guide pulleys which are provided with a guidance groove and are staggered, where the running surface of the innermost guide pulley is approximately tangent to the second twisting stage ("Wire Journal" February, 1978, pages 74 to 79, FIG. 7; Bulletin "Nachrichtenkabel-SZ-Verseilmaschinen", of the firm Frisch, Germany). If ten or more SZ-twisting devices are arranged operating in parallel in the first twisting stage, a very crowded design of the guide pulleys is necessary at the transition from the first to the second twisting stage in order to ensure free paths as short as possible for guiding the twisting units (giving consideration to the undesired untwisting of the reversal points of the twist direction). On the other hand, enough space must be provided so that equipment problems in the area of the guidance system can be corrected.

Starting from a two-stage twisting device of the type described above, it is an object of the present invention to provide a mechanical design of the first twisting stage and the guidance system arranged between the two twisting stages in such a manner that even with more than ten SZ-twisting devices arranged for parallel operation in the first twisting stage (multiple SZ-device) ease of operation of the multiple SZ-device as well as of the guidance system is provided as well as bringing the twisting units as close as possible to the machine axis and, therefore, as close as possible to the twisting head of the second twisting stage, while keeping transverse dimensions of the multiple SZ-device as small as possible.

SUMMARY OF THE INVENTION

According to the present invention, for solving this problem, in the first twisting stage, the twisting heads are arranged in at least two groups of twisting heads with the twisting heads of each radially staggered with respect to the other; between the staggered twisting heads, further guide pulleys for the twisting unit associated with the respectively outer twisting head are arranged and, of the guide pulleys arranged between the machine axis and an inner twisting head, at least guide pulleys closest to the machine axis are provided with further guiding grooves for twisting units assigned to the outer twisting heads.

In a two-stage twisting device designed in this manner, the mutual correlation of the twisting heads in the two groups is geometrically corrected by the radially staggered arrangement of the rotating twisting heads. By the design of inner guide pulleys with two or more guidance grooves, the space required for supporting the inner guide pulleys is reduced considerably. It is particularly advantageous here if the additional guidance grooves of one or more inner guide pulleys are formed by additional guide pulleys which are rotatably supported on the same axis as the original guide pulley, but are rotatable independently thereof. This applies primarily to guide pulleys in which the looping angle through the respective twisting unit is more than 90°. In this case, differences in the running length between twisting units which are fed on the one hand to the core, and on the other hand to the outer layer or to different layers of the bundle to be manufactured can be equalized without trouble.

The staggered twisting heads can be arranged on concentric pitch circles and, optionally, at least two twisting heads can be disposed at the same angular position. Thereby, a very clear-cut, star-like design of the multiple SZ-device of the first twisting stage is obtained. The possibility for associating staggered twisting heads with a common drive set exists. Advantageously, the drive sets are arranged coaxially to the respective outer twisting head, so that ready access to these sets at the periphery of the machine is provided. It is also advisable to arrange additional deflection pulleys, which are required for the local offset of twist changing points of twisting units adjacent in the bundle, likewise at the periphery of the machine and to thereby assign them to the SZ-twisting devices located further outward. The new SZ-twisting device is suitable particularly for the manufacture of bundles with thirteen to twenty-five pairs or star quads. If the twisting heads are arranged on two concentric pitch circles and with an uneven number of pairs or star quads, one twisting axis advantageously remains unoccupied on the inner pitch circle.

If the twisting heads are arranged on three pitch circles, the guide pulleys of the guidance system located between the machine axis and the inner pitch circle must be provided, in a consistent further embodiment of the invention, with three guidance grooves; the guide pulleys located between the inner and the central pitch circle, with two guidance grooves; and the guide pulleys arranged between the central and the outer pitch circle, with one guidance groove each.

Deviating from a concentric arrangement of the twisting heads, in a further embodiment of the present invention, the twisting heads can also be arranged in two groups on both sides of an imaginary plane extending through the machine axis. Advantageously, the two twisting head groups are then arranged symmetrically to the imaginary plane. Thereby, ready access is obtained to the twisting heads which are staggered radially and to their driving devices. It is of advantage here if the inner twisting heads and the outer twisting heads of each twisting head group are arranged on two parallel lines, for instance, straight lines or also on parallel lines curved in barrel fashion, and the twisting heads of each twisting head group, perpendicular to the imaginary plane, at least partially with the mutual gaps. With this arrangement of the twisting heads, it also makes sense to provide each twisting head with a driving device of its own.

DETAILED DESCRIPTION

Figure 1:
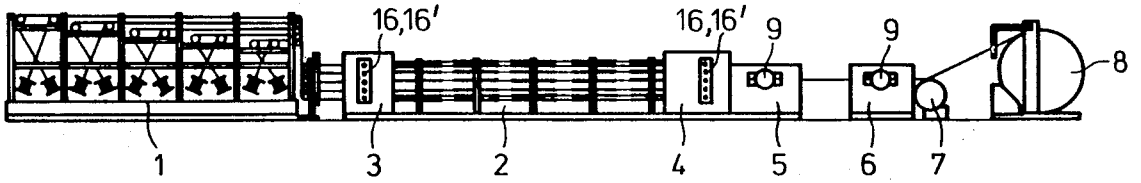
FIG. 1 is a schematic diagram, illustrating the basic design of the twisting device of the present invention.

FIG. 1 shows schematically a two-stage twisting device with which 20 to 50 conductors of a communication cable can be twisted into a bundle. To this end, the conductors first run from a supply frame 1 into the first twisting stage 2 which consists of several SZ-twisting devices arranged for parallel operation. In a manner known per se, each SZ-twisting device consists of two rotating twisting heads 16 and 16' which are spaced from each other and are disposed in the present case at the entrance of the first twisting stage in the frame 3 and at the exit of the twisting stage in the frame 4. In the known SZ-twisting machines as are described in the bulletin "Nachrichtenkabel-SZ-Verseilmaschinen" of the firm Frisch, the twisting heads 16 of all individual SZ-twisting devices are arranged on one pitch circle concentric to the machine axis. The first twisting stage is followed by the second twisting stage, in which twisting heads 9 arranged with mutual spacing are arranged in the stands 5 and 6, all twisting units leaving the first twisting stage being twisted to form a bundle. Subsequently, the bundle is pulled off by means of the pulling-off device 7 and is wound up by the take-up device 8.

Figure 2:
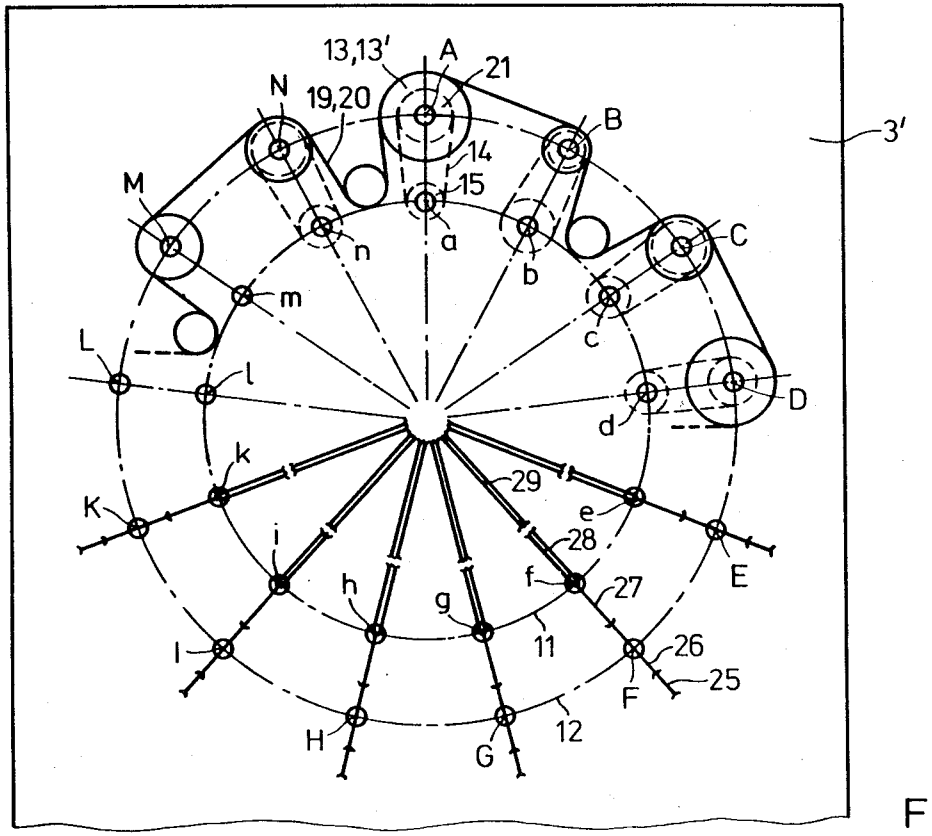
FIG. 2 shows a radially staggered concentric arrangement of the twisting axes of the SZ-twisting devices of the first twisting stage, arranged for parallel operation.

In a first embodiment of a two-stage twisting device which is designed in accordance with the present invention and with which more than ten twisting units are twisted to form a bundle, the twisting heads of the individual SZ-twisting devices of the first twisting stage are arranged on at least two pitch circles concentrically with the machine axis. Such an arrangement is shown in FIG. 2 where a schematic front view of a frame 3' is shown. The pitch circles 11 and 12 are concentric with the machine axis 10. On these pitch circles are arranged, uniformly distributed, the twisting axes of the individual SZ-twisting devices, where the twisting axes of the SZ-twisting devices arranged on the outer pitch circle 12 are designated with the capital letters A to N, and the twisting axes of the SZ-twisting devices arranged on the inner pitch circle 11 with the corresponding small letters a to n. The drawing according to FIG. 2 shows essentially the geometric correlation of the different twisting axes. Indicated are further drive wheels 13 and 13' for the outer twisting heads, these driving wheels being coupled to each other via drive belts 19 and 20. It is further indicated that on each outer twisting axis, a drive wheel 21 is located which is coupled via a drive belt 14 to a drive wheel 15 on the respectively inner twisting axis. For reasons of clarity of the graphic presentation, only the twisting axes arranged in the upper part of the frame 3' are shown in FIG. 2, while in the lower part of the Figures, the guidance system for guiding the twisting units from the first twisting stage to the second twisting stage is shown. This is also shown in a side view in FIG. 4.

Figure 4:
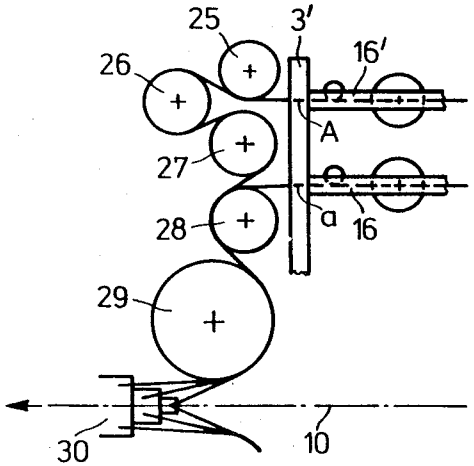
FIG. 4 shows the guidance system associated with these two twisting heads at the transition from the first to the second twisting stage.

According to FIG. 4, the guidance of a twisting unit which was made in line with the twisting axis A is by guide pulleys 25, 26 and 27 which bring the twisting unit to the proximity of the twisting axis a. From there, the further guidance is taken over by guidance pulleys 28 and 29, which guide at the same time the twisted unit coming from the twisting axis a. To this end, the guidance pulleys 28 and 29 are provided with two guidance grooves while the guidance pulleys 25, 26 and 27 have only one guidance groove. The pulley 29 has its running surface approximately tangent to the machine axis 10, so that the twisting units enter into the twisting closer 30 of the second twisting stage via the shortest path.

Figure 5:
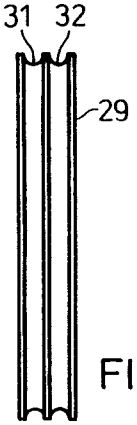
Figure 6:
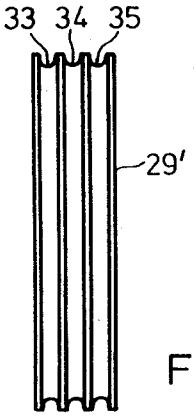

In FIGS. 2 and 4, the guide pulleys 25 and 29 are shown only schematically. A more detailed view of the guide pulleys 28 and 29 is seen in FIG. 5, from which the gooves 31 and 32 adjacent to each other can be seen. FIG. 6 shows a guide pulley 29' which is provided with three grooves 33, 34 and 35 arranged side by side. Such a guide pulley is necessary if the SZ-twisting devices of the first twisting stage are arranged on three concentric pitch circles.

Figure 7:
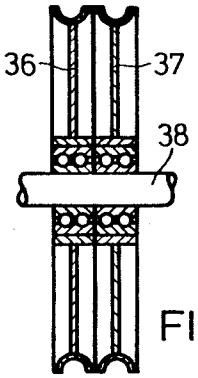
FIGS. 5, 6 and 7 show guide pulleys grooved two or three times.

According to FIG. 7, the inner guide pulley 29 or the guide pulleys 28 and 29 in FIG. 4 can also consist of two or three pulley sections 36 and 37 which are arranged immediately next to each other and are supported on the same shaft 38 independently of each other.

Figure 3:
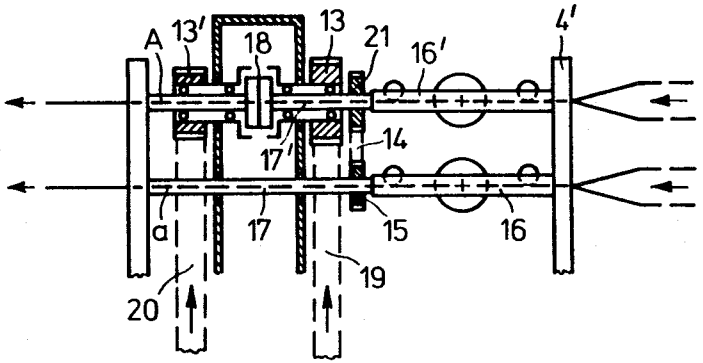
FIG. 3 illustrates a driving device for two twisting heads arranged radially staggered.

According to FIG. 4, the guidance system of the individual twisting heads 16 and 16' is preceded by the individual twisting heads 16 and 16' at the exit of the respective SZ-twisting device. FIG. 3 shows the same twisting heads at the entrance of the first SZ-twisting stage, the associated drive system being shown schematically at the same time. The design of the twisting heads 16 and 16' and the associated drive system corresponds substantially to the design known from British Pat. No. 1,478,351. Accordingly, each twisting head 16 and 16' is mounted on a hollow shaft 17 or 17', respectively, on which drive wheels 13 and 13' are supported rotatably. Between the drive wheels is located a double-acting clutch system 18, via which either the drive wheel 13 or the drive wheel 13' comes into engagement with the shaft 17. The drive system is coupled to the twisting axis A, while the twisting head 16 arranged on the twisting axis a is driven via the drive wheel 21, the driving belt 14 and the drive wheel 15. The driving belts 19 and 20 are associated with the drive wheels 13 and 13'.

Figure 8:
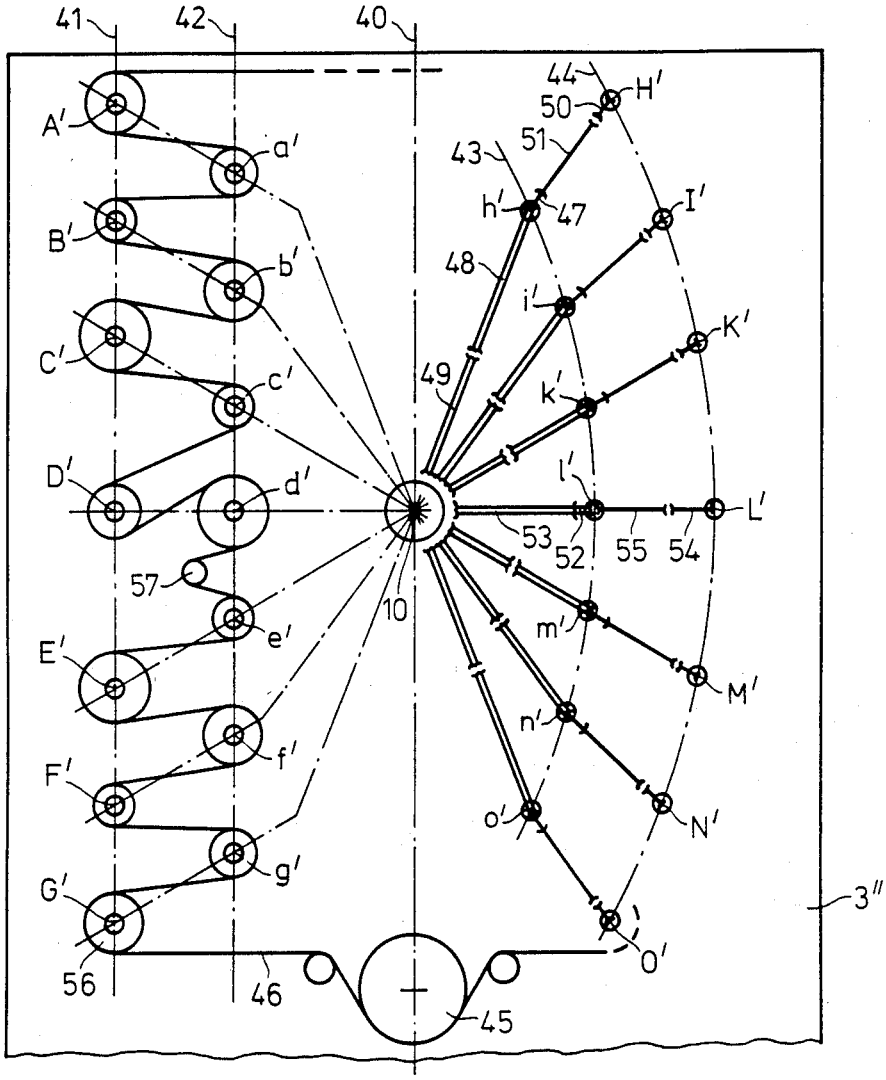
FIG. 8 shows a radially staggered arrangement of the twisting axes, subdividing the twisting heads into two twisting head groups on both sides of the machine axis.

In a second embodiment of a two-stage twisting device designed in accordance with the present invention for the manufacture of a bundle consisting of 28 pairs, the twisting heads of the individual SZ-twisting devices of the first twisting stage are arranged in two groups on both sides of a vertical plane 40 taken through the machine axis 10. Such an arrangement is shown in FIG. 8, where a schematic front view of the frame 3'' is given. The twisting axes of the two twisting head groups are arranged here along two parallel straight lines 41 and 42, as shown in the left hand part of the Figure, or along two parallel or concentric curved lines 43 and 44, as shown in the right hand part of the Figure. In the Figure, the respective twisting axes A' to G' and a' to g' of the left hand twisting head group and the twisting axes H' to 0' and h' to o' of the right hand twisting head group are indicated. More specifically, in the left hand part a gear 56 belonging to the respective drive arrangement is shown, and in the right hand part a schematic view of the respectively associated guide pulleys 47 to 51 and 52 to 55 is shown. The radially staggered guide pulleys are indicated in the left hand part by dashed-dotted lines. It can be seen here that the radial staggering of twisting heads of the two groups and also the staggering of the corresponding guide pulleys need not be made along the same radius, but along different or angled-off radii.

In an embodiment with an uneven number of twisting heads, for instance, with 25 twisting heads, it is advisable to arrange half of the twisting heads minus one, i.e., for instance 12 twisting heads on the one side and the other half of the twisting heads reduced by one twisting head on the other side of the imaginary plane 40, while the remaining twisting head is arranged between the two twisting heads in the plane 40.

The drive of the different SZ-twisting devices is accomplished in the embodiment according to FIG. 8 jointly by a main drive 45 which is coupled via a serrated belt 46 to the drive wheels 56 of the individual twisting head drives. The two twisting head groups can also be driven separately. Deflection wheels 57 may be required.

Figure 9:
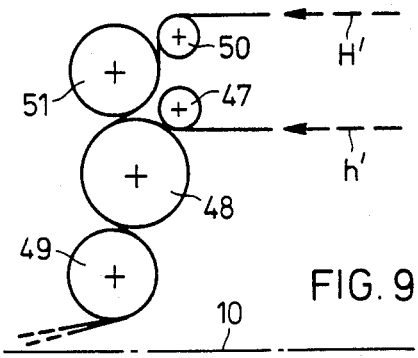
FIGS. 9 and 10 show two further examples for the arrangement of guide pulleys at the transition from the first to the second twisting stage.

According to FIG. 9, the guidance system for guiding the twisting units from the first twisting stage into the twisting closer of the second twisting stage can include three guide pulleys 47, 48 and 49, each in the region between the machine axis 10 and the inner twisting heads and of two guide pulleys 50 and 51 staggered in the region between the two twisting heads. The twisting unit of the respective outer twisting head, therefore, for instance, of the twisting axis H' does not run onto the other guide pulley 47 of the twisting axis h' but only on the central guide pulley 48. In this case, only the guide pulleys 48 and 49 have two guide grooves. Advantageously, the guide pulley 48 consists of two pulley sections which are mounted independently of each other on the same shaft, according to the embodiment in FIG. 7.

Figure 10:
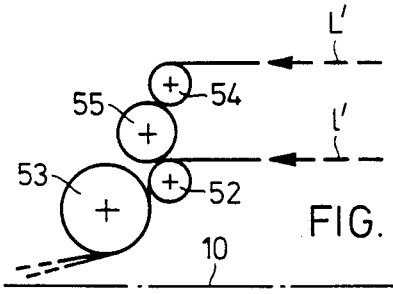

According to FIG. 10, the guidance system for two staggered twisting axes 1' and L' can consist of four guide pulleys where the twisted unit of the twisting axis L' is conducted first over the single groove guide pulleys 54 and 55 and, subsequently, together with the twisted units of the twisting axis 1' via the double grooved guide pulleys 52 and 53 to the proximity of the twisting axis 10. In this case, the two guide pulleys 52 and 53 need not consist of two pulley sections mounted independently of each other on the same shaft because of the small looping angle.

What is claimed is:

1. In a two stage twisting device, having a machine axis, for the simultaneous twisting of conductors for communication cables to form at least ten twisted units such as pairs or star quads and for the immediately subsequent twisting of the twised units to form a bundle, including:

(a) several SZ-twisting devices arranged in a first twisting stage operating in parallel and each of said SZ-twisting devices having, at the exit of the first twisting stage, a rotating twisting head, with said twisting heads arranged in a frame radially disposed with respect to the machine axis;

(b) at the transition from the first to the second twisting stage, a guidance system for each twisted unit for the deflection of the twisted units into the machine axis, said guidance system including at least two guide pulleys which are provided with a guiding groove, staggered with respect to each twisting unit, the running surface of the innermost guide pulley being approximately tangential to the machine axis; and (c) a second twisting stage with its twisting axis on said machine axis, the improvement comprising;

(d) the twisting heads of the twisting devices of the first twisting stage arranged in at least two groups radially staggered to form at least an inner and an outer group of twisting heads;

(e) further guide pulleys for the twisted units associated with the outer twisting heads disposed between the inner and outer twisting heads; and (f) guide pulleys between the machine axis and the inner twisting heads which are closest to the machine axis having a further guiding groove for a further twisting unit associated with an outer twisting head.

2. A twisting device according to claim 1, wherein the guiding grooves of said pulleys with a further guiding groove are formed by a plurality of guide pulleys which are each supported on the same axis but are independently rotatable.

3. A twisting device according to claim 1, wherein said twisting heads are distributed concentrically about the machine axis on at least two pitch circles.

4. A twisting device according to claim 1, and further including a common drive set for the respective twisting heads of the two groups.

5. A twisting device according to claim 4, wherein said drive set is coupled to the group of outer twisting heads and means are provided coupling the outer twisting heads to the inner twisting heads.

6. A twisting device according to claim 1, wherein said groups of twisting heads are disposed on both sides of an imaginary plane extending through the machine axis.

7. A twisting device according to claim 6, wherein said two groups of twisting head are arranged symmetrically with respect to the imaginary plane.

8. A twisting device according to claim 7, wherein the inner twisting heads and the outer twisting heads of each twisting head group are arranged on two parallel lines.

9. A twisting device according to claim 6, wherein the inner and outer twisting heads of each twisting head group are arranged perpendicular to the imaginary plane and at least partly at mutual gaps.

10. A twisting device according to claim 6, wherein each twisting head is provided with a drive device of its own.

* * * * *